US007621079B2

(12) United States Patent
Takagi et al.

(10) Patent No.: US 7,621,079 B2
(45) Date of Patent: Nov. 24, 2009

(54) WATER DRAINAGE COMPONENT

(75) Inventors: Kyozaburo Takagi, Centerville, OH (US); Kenjiro Yoshida, Tokyo (JP)

(73) Assignee: Fukuvi USA, Inc., Huber Heights, OH (US)

( * ) Notice: Subject to any disclaimer, the term of this patent is extended or adjusted under 35 U.S.C. 154(b) by 675 days.

(21) Appl. No.: 11/267,412

(22) Filed: Nov. 4, 2005

(65) Prior Publication Data

US 2006/0156641 A1 Jul. 20, 2006
US 2007/0169425 A2 Jul. 26, 2007

Related U.S. Application Data

(60) Provisional application No. 60/644,488, filed on Jan. 14, 2005, provisional application No. 60/690,456, filed on Jun. 14, 2005.

(51) Int. Cl.
*E04B 1/70* (2006.01)
*E04F 17/00* (2006.01)

(52) U.S. Cl. ..... 52/169.5; 52/302.3; 52/61; 52/100

(58) Field of Classification Search ..... 52/60, 52/61, 62, 169.5, 302.6, 302.3, 98, 100, 310, 52/378, 302.1, 97, 209, 513; 405/229
See application file for complete search history.

(56) References Cited

U.S. PATENT DOCUMENTS 3,293,810 A * 12/1966 Cox et al. ..... 52/302.6
4,745,716 A * 5/1988 Kuypers ..... 52/169.5
4,841,687 A * 6/1989 Navetta ..... 52/58
4,869,032 A * 9/1989 Geske ..... 52/169.5
5,343,661 A 9/1994 Sourlis
5,519,969 A * 5/1996 Golba ..... 52/60
5,598,673 A 2/1997 Atkins
5,692,348 A 12/1997 Ambrosino
5,794,388 A * 8/1998 Jackman ..... 52/169.5
5,884,435 A * 3/1999 David et al. ..... 52/62
5,937,594 A 8/1999 Sourlis
5,937,600 A * 8/1999 Larson ..... 52/302.6
6,023,892 A * 2/2000 Sourlis ..... 52/169.5
RE36,676 E 5/2000 Sourlis
6,119,429 A * 9/2000 Bifano et al. ..... 52/831

(Continued)

OTHER PUBLICATIONS

Totalflash, Cavity-Wall Drainage System, by MortarNet USA Ltd., pp. 1-2.

*Primary Examiner*—Robert J Canfield
*Assistant Examiner*—Jessie Fonseca
(74) *Attorney, Agent, or Firm*—Dinsmore & Shohl LLP

(57) ABSTRACT

A water drainage component comprises a foundation engaging member, a structural wall engaging member, a gutter, and at least one water drainage channel. The foundation engaging member is configured to abut a substantially planar portion of a foundation of a building structure. The structural wall engaging member is substantially perpendicular to the foundation engaging member, and at least a portion of the structural wall engaging member is configured to abut a structural wall of a building structure. The gutter defines a water collection area configured to collect water flowing along at least a portion of the structural wall engaging member in the direction of the foundation engaging member, and the water drainage channel defines a conduit in fluid communication with the water collection area extending along a portion of the foundation engaging member, and the water drainage channel is configured to drain water collected in the gutter.

37 Claims, 9 Drawing Sheets

U.S. PATENT DOCUMENTS

| | | | | |
|---|---|---|---|---|
| 6,256,955 | B1 * | 7/2001 | Lolley et al. | 52/302.3 |
| 6,410,118 | B1 * | 6/2002 | Reicherts et al. | 428/141 |
| 6,584,746 | B1 * | 7/2003 | Hohmann et al. | 52/513 |
| 6,912,820 | B2 | 7/2005 | Sourlis | |
| 2001/0023564 | A1 | 9/2001 | Phillips | |
| 2002/0115367 | A1 * | 8/2002 | Lolley et al. | 442/6 |
| 2002/0152693 | A1 * | 10/2002 | Krogstad | 52/58 |
| 2003/0230035 | A1 * | 12/2003 | Collins et al. | 52/209 |
| 2004/0093806 | A1 | 5/2004 | Marees | |
| 2004/0182037 | A1 | 9/2004 | Sourlis | |
| 2004/0231259 | A1 * | 11/2004 | Sourlis | 52/302.1 |
| 2004/0231261 | A1 | 11/2004 | Sourlis | |
| 2005/0138876 | A1 | 6/2005 | Sourlis | |
| 2005/0204653 | A1 * | 9/2005 | Matthews | 52/169.5 |
| 2006/0283102 | A1 * | 12/2006 | Sourlis | 52/62 |
| 2006/0283113 | A1 * | 12/2006 | Trotter | 52/302.3 |

* cited by examiner

WATER DRAINAGE COMPONENT

CROSS-REFERENCE TO RELATED APPLICATIONS

This application claims the benefit of U.S. Provisional Application Ser. Nos. 60/644,488 (FUU 0050 MA), filed Jan. 14, 2005, and 60/690,456 (FUU 0050 M2), filed Jun. 14, 2005.

SUMMARY OF THE INVENTION

The present invention relates generally to a system of waterproofing a building structure by eliminating water seepage into the interior of a building structure and diverting water away from the building structure. The water drainage component can be utilized on a residential or commercial building with finishes comprised of brick, block, siding, stucco, or any other suitable material, and may also be used in other structures such as window structures.

According to one embodiment of the present invention, a water drainage component is provided. The water drainage component comprises a foundation engaging member, a structural wall engaging member, a gutter, and at least one water drainage channel. The foundation engaging member is configured to abut a substantially planar portion of a foundation of a building structure. The structural wall engaging member is substantially perpendicular to the foundation engaging member, and at least a portion of the structural wall engaging member is configured to abut a structural wall of a building structure. The gutter defines a water collection area configured to collect water flowing along at least a portion of the structural wall engaging member in the direction of the foundation engaging member, and the water drainage channel defines a conduit in fluid communication with the water collection area extending along a portion of the foundation engaging member, and the water drainage channel is configured to drain water collected in the gutter.

According to a second embodiment of the present invention, a system comprising at least one water drainage component is provided. The water drainage component comprises a foundation engaging member, a structural wall engaging member, a gutter, and at least one water drainage channel. The foundation engaging member is configured to abut a substantially planar portion of a foundation of a building structure. The structural wall engaging member is substantially perpendicular to the foundation engaging member, and at least a portion of the structural wall engaging member is configured to abut a structural wall of a building structure. The gutter defines a water collection area configured to collect water flowing along at least a portion of the structural wall engaging member in the direction of the foundation engaging member, and the water drainage channel defines a conduit in fluid communication with the water collection area and extending along a portion of the foundation engaging member. The water drainage channel is configured to drain water collected in the gutter. The system further comprises at least one horizontal connector piece configured to couple to at least one water drainage component wherein the water drainage component is coupled to the horizontal connector piece by slidingly inserting at least one track insert extending lengthwise along the horizontal connector piece into at least one track extending lengthwise along a portion of the foundation engaging member and/or structural wall engaging member. The system also comprises at least one vertical extender piece configured to couple to the structural wall engaging member.

Other features and embodiments of the present invention will be apparent in light of the description of the invention embodied herein.

BRIEF DESCRIPTION OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
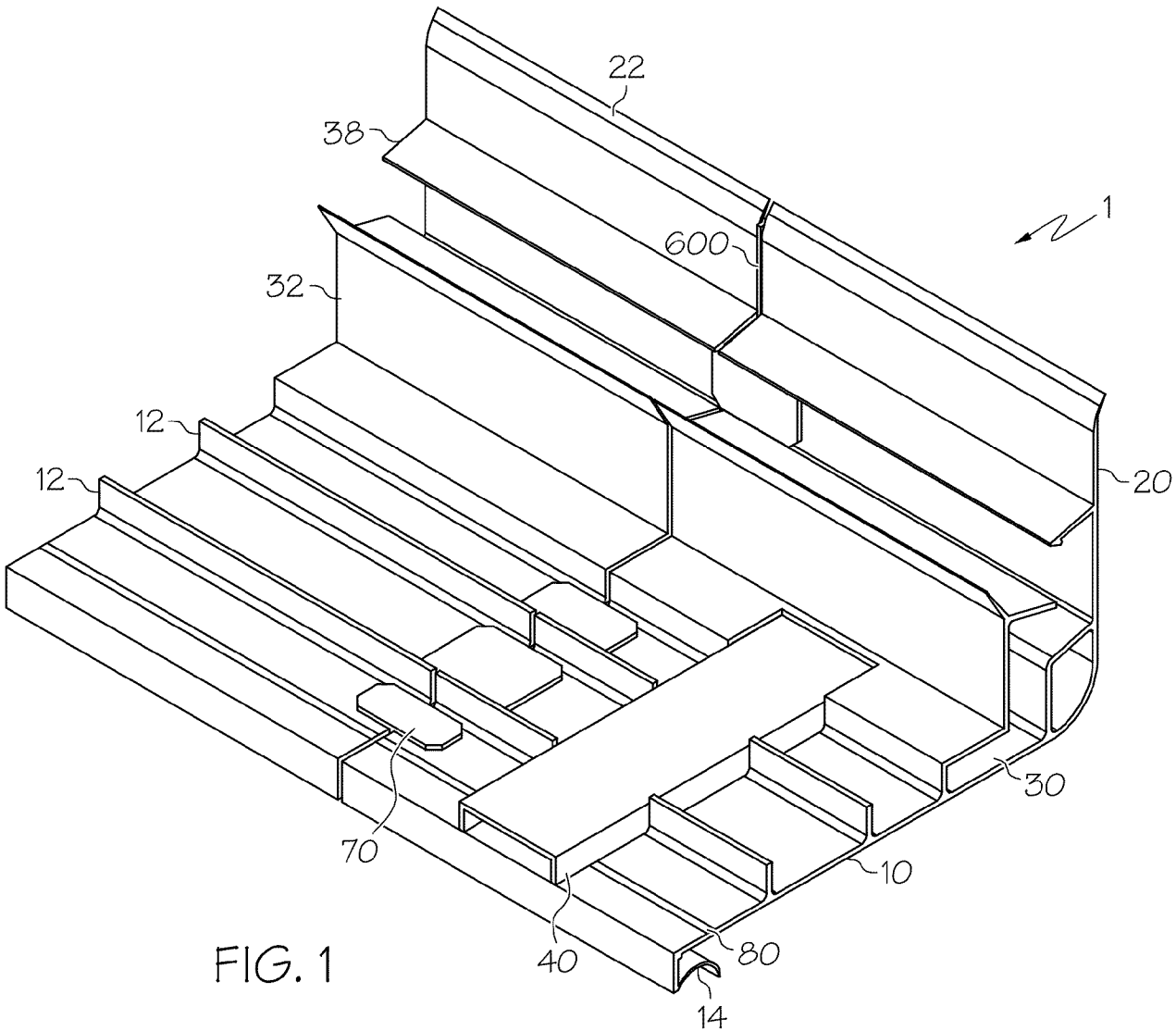
FIG. 1 is a front view of the water drainage component according to one or more embodiments of the present invention.
Figure 2:
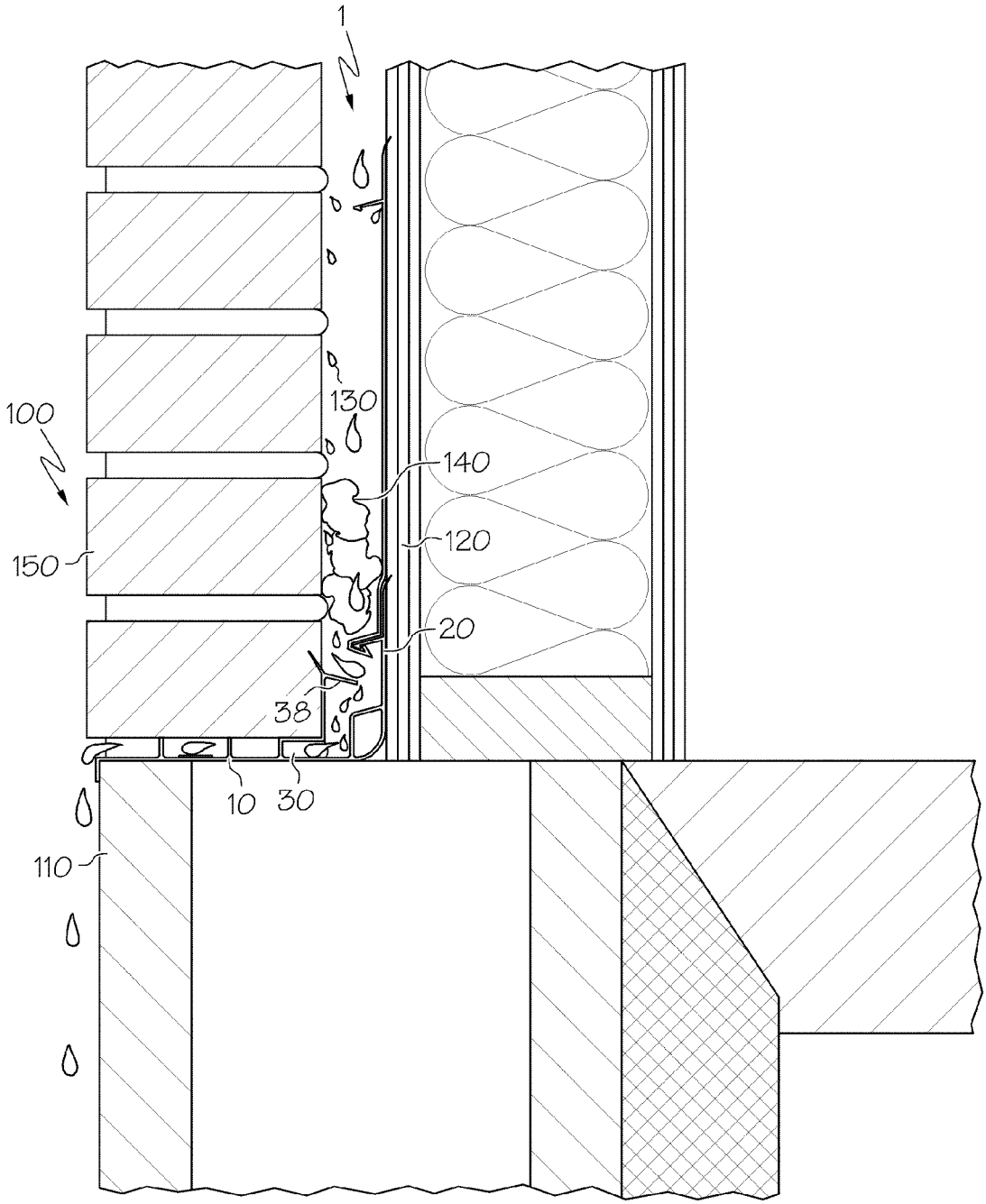
FIG. 2 is a cross sectional view of the water drainage component incorporated into a building structure according to one or more embodiments of the present invention.

The present invention generally relates to water drainage components and specifically relates to water management components incorporated in various structures, such as buildings and window structures. Referring to FIGS. 1 and 2, one embodiment of a water drainage component 1 is provided. The water drainage component comprises a foundation engaging member 10, a structural wall engaging member 20, a gutter 30, and at least one water drainage channel 40. The foundation engaging member 10 is configured to abut a substantially planar portion 110 of a foundation of a building structure 100, and the structural wall engaging member 20 is substantially perpendicular to the foundation engaging member 10. At least a portion of the structural wall engaging member 20 is configured to abut a structural wall 120 of a building structure 100.

The gutter 30 defines a water collection area configured to collect water 130 flowing along at least a portion of the structural wall engaging member 20 in the direction of the foundation engaging member 10. The water drainage channel 40 defines a conduit in fluid communication with the water collection area 30 and extending along a portion of the foundation engaging member 10, and the water drainage channel 40 is configured to drain water collected in the gutter 30.

In further embodiments, the water drainage component 1 defines an extruded cross sectional profile comprises of an extruded rigid material. The rigid material may be selected from a plastic material, e.g., polyvinyl chloride (PVC), low or high-density polyethylene or polypropylene, acrylics, polycarbonates, thermoplastic elastomers, etc.

Figure 3:
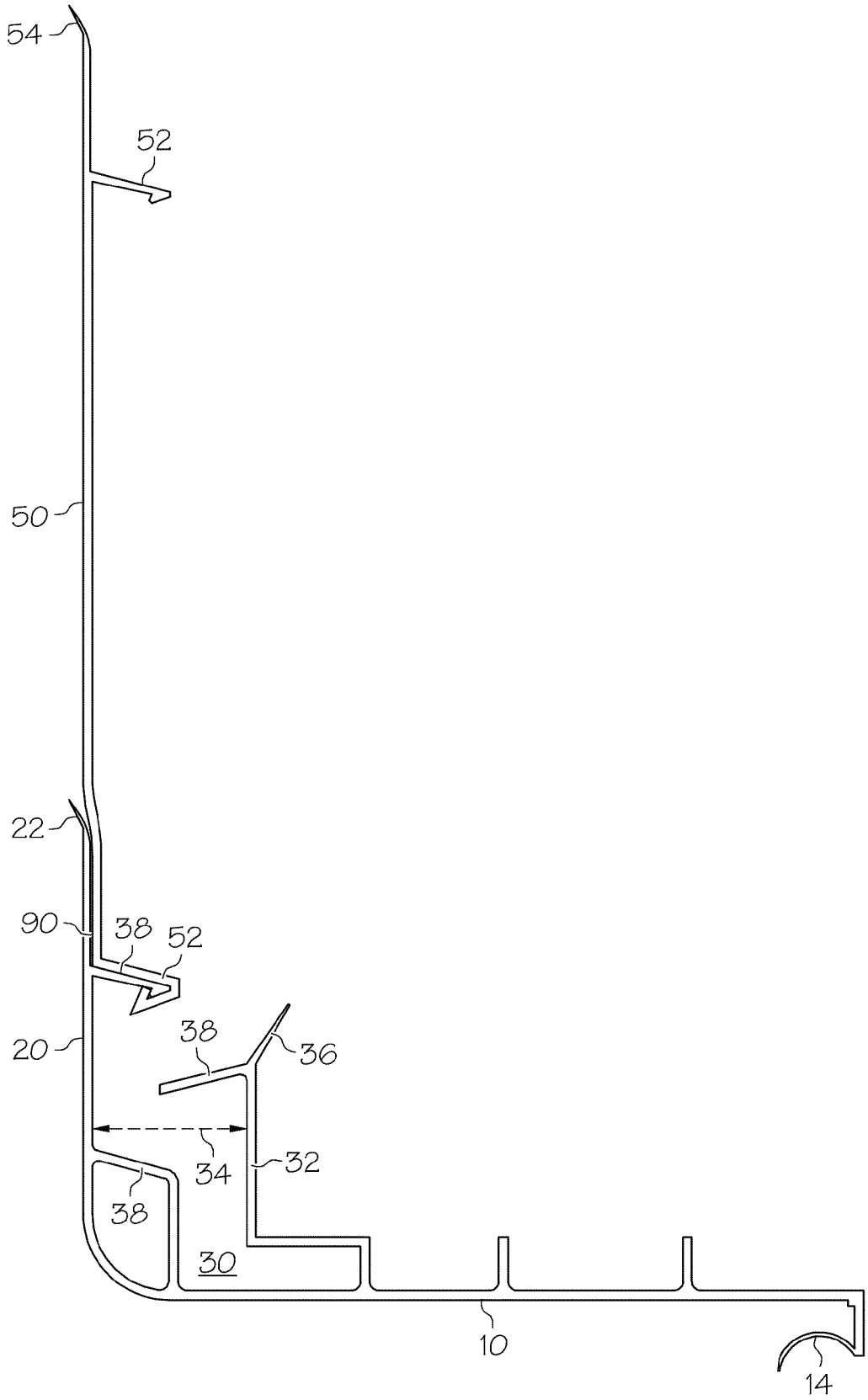
FIG. 3 is a side view of the water drainage component according to one or more embodiments of the present invention.

Referring to FIG. 3, the gutter 30 may be defined at the junction of the foundation engaging member 10 and the structural wall engaging member 20. Optionally, the gutter 30 may comprise an exterior finish engaging member 32 configured to define a spacing 34 between an exterior finish 150 and a structural wall 120. As shown in FIG. 3, the gutter 30 may have its boundaries defined by the exterior finish engaging member 32, the structural wall engaging member 20, and the foundation engaging member 10. In addition, the exterior finish engaging member 32 may comprise a pliable seal 36 configured to contact the exterior finish 150. Typically, the pliable seal 36, and other pliable seals utilized in the water drainage component 1, comprise material having greater flexibility than the material of the water drainage component 1 listed above. The pliable seals may be extruded using softer plastics like soft, flexible thermoplastic elastomers, or other relatively soft materials. In one embodiment, the pliable seal comprises soft PVC material.

Figure 6:
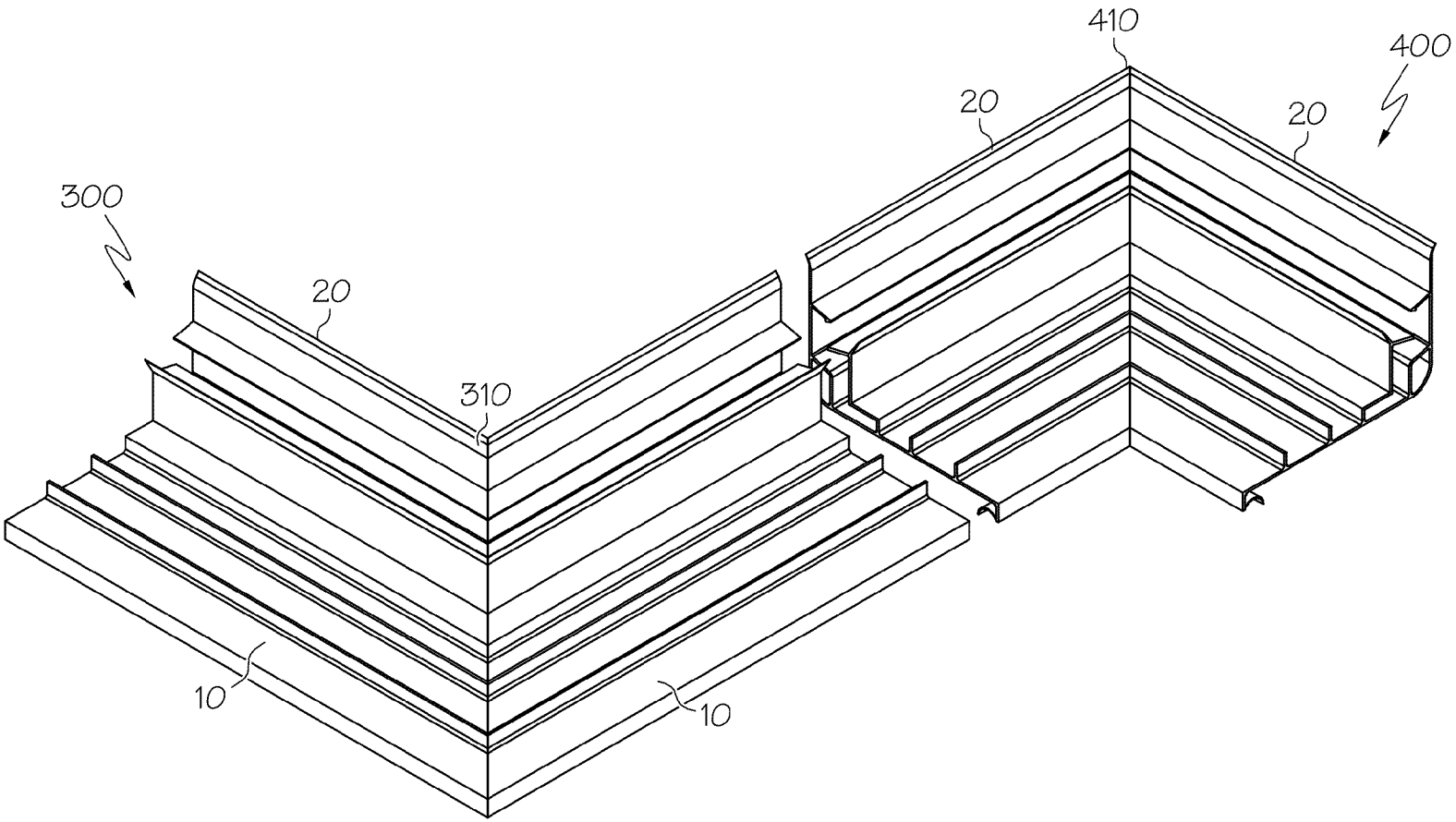
FIG. 6 is a front view of an inner corner water drainage component piece and an outer corner water drainage component piece according to one or more embodiments of the present invention.

The exterior finish engaging member 32 may further comprise a debris blocking member 38. As shown in FIG. 2, the debris blocking member 38 may be configured to allow passage of water 130 into the gutter 30 while preventing passage of mortar 140 into the gutter 30. The debris blocking member 38 may at least partially cover the gutter 30 and extends from the exterior finish engaging member 32 or the structural wall engaging member 20. The debris blocking member 38 may define numerous configurations. Referring to FIG. 6, the debris blocking member 38 may comprise a slanted member, a porous straining device with a pore size less than the size of debris, and/or a plurality of opposing staggered projections 38 extending from the exterior finish engaging member 32 and the structural wall engaging member 20. Referring to FIG. 3, the debris blocking member may comprise three slanted projections 38 arranged in a staggered configuration.

Figure 4:
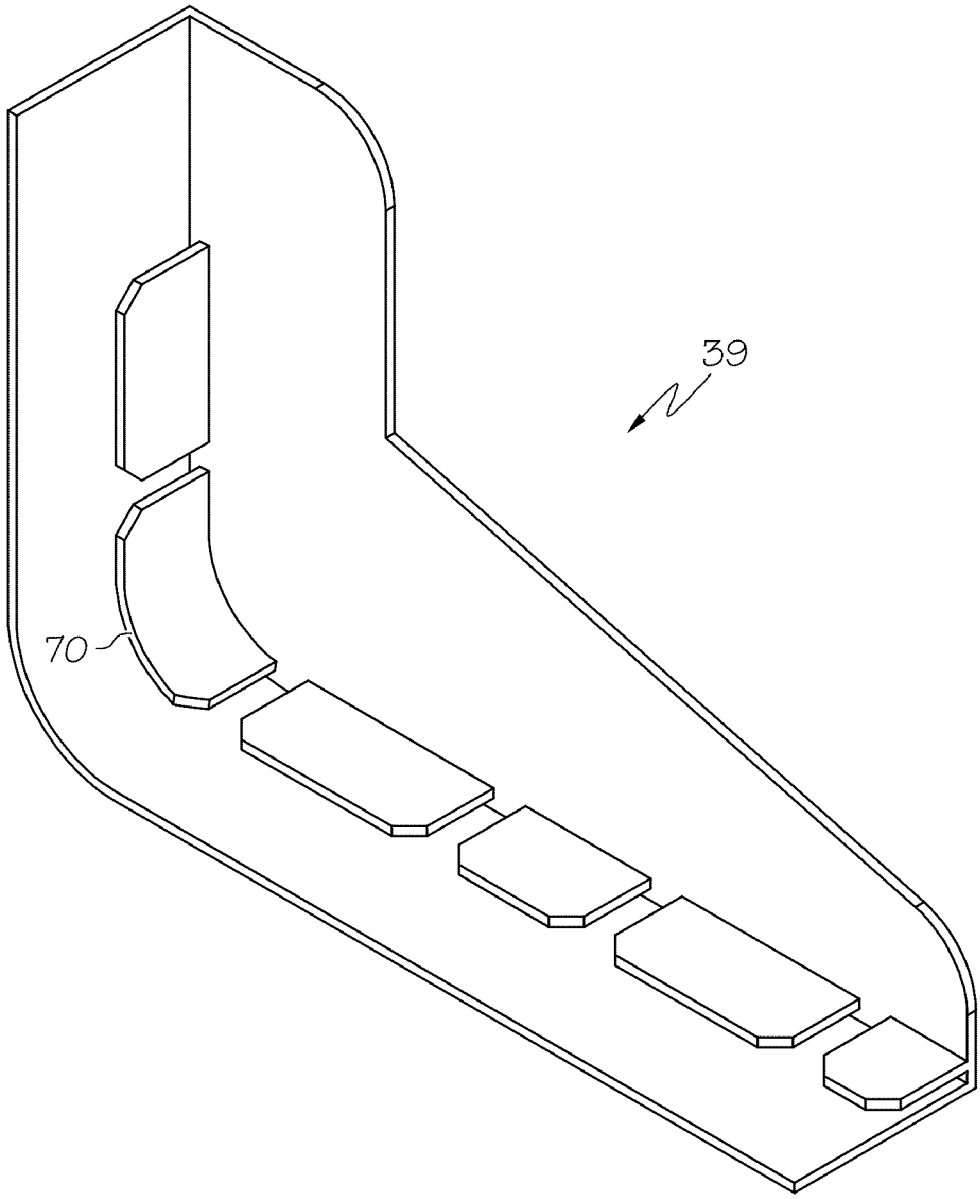
FIG. 4 is a front view of the gutter water barrier according to one or more embodiments of the present invention.
Figure 5:
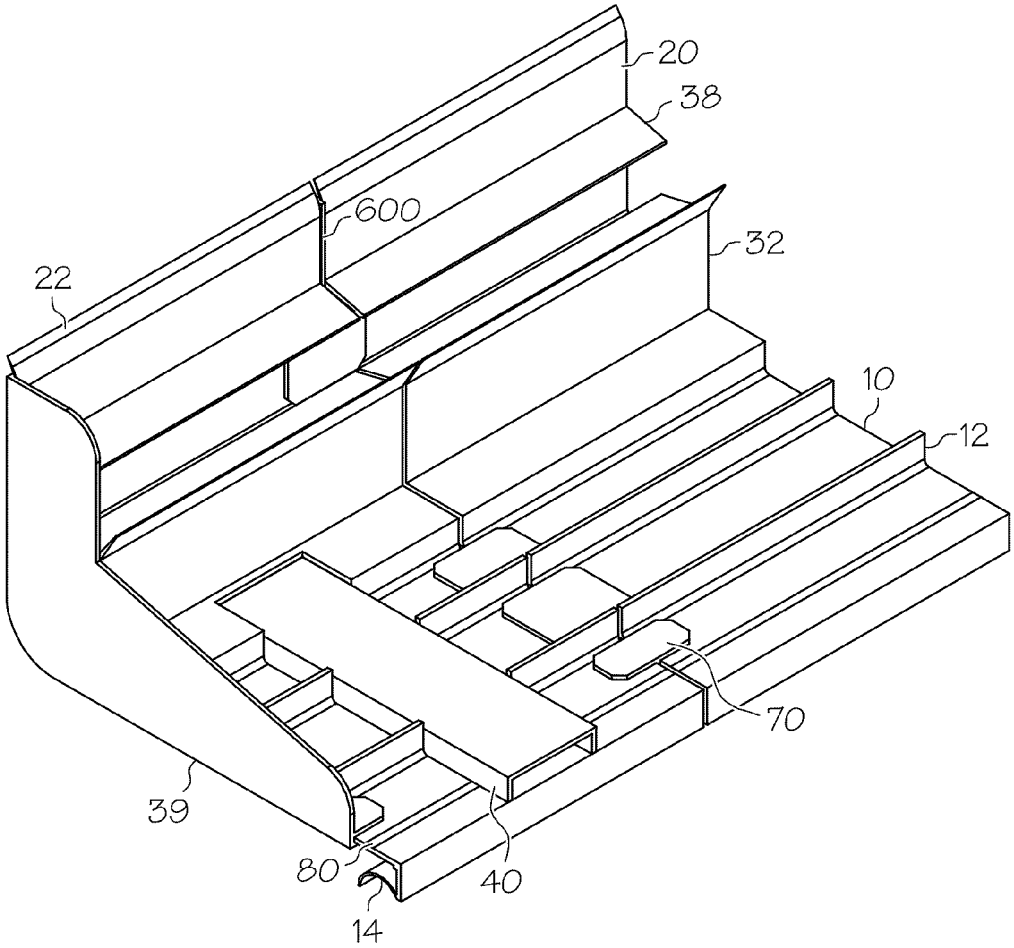
FIG. 5 is a front view of the water drainage component coupled to a gutter water barrier according to one or more embodiments of the present invention.

In accordance with another embodiment as shown in FIG. 4, the water drainage component 1 may further comprise a gutter water barrier 39 configured to plug the spacing between the structural wall engaging member 20 and an exterior finish engaging member 32 on at least one end. In one embodiment as shown in FIG. 5, the gutter water barrier 39 is inserted into the gutter 30 and may be configured to ensure that water does not leak out of the sides of the gutter 32, thereby ensuring water is diverted through the water drainage channel 40.

In accordance with another embodiment of the present invention, the water drainage component 1 may comprise a plurality of water drainage channels 40 spaced along the foundation engaging member 10. As shown in FIG. 1, the water drainage channel 40 comprises at least one void formed in the surface of foundation engaging member 10, and at least one sleeve inserted in the void. Typically, the void is created by routing openings in the tracks 12, and then inserting a sleeve of cap in these voids. The sleeve may comprise a rigid material similar to the rigid materials used in the water drainage component described above.

In yet another embodiment, the water drainage component 1 may comprise at least one pliable seal oriented at one or more edges of the foundation engaging member 10 and/or the structural wall engaging member 20, wherein the pliable seals are configured to contact the foundation 110 and/or the structural wall. Referring to FIGS. 1 and 3, the foundation engaging member comprises a pliable seal 14 at its edge, and the structural wall engaging member 20 also comprises a pliable seal 22 at its edge. The seal 14 located at the edge of the foundation engaging member 10 defines a curved shape configured to engage a foundation edge. The seals are configured to engage these surfaces to prevent water flow behind or underneath the water drainage component 1.

In further embodiments as shown in FIG. 6, the water drainage component 1 may define an outer corner piece 300 or an inner corner piece 400. In the outer corner piece 300, the structural wall engaging member 20 is configured to abut two adjacent structural walls joined at an outer corner 310. In the inner corner piece 400, the wherein the structural wall engaging member 20 is configured to abut two adjacent structural walls joined at an inner corner 410. In one embodiment as shown in FIG. 5, the outer piece 300 and the inner piece 400 may abut walls that perpendicularly join at a corner; however, the outer 300 and inner corner 400 pieces may abut two walls connected at a non-perpendicular corner junction, or even a rounded junction.

Figure 7:
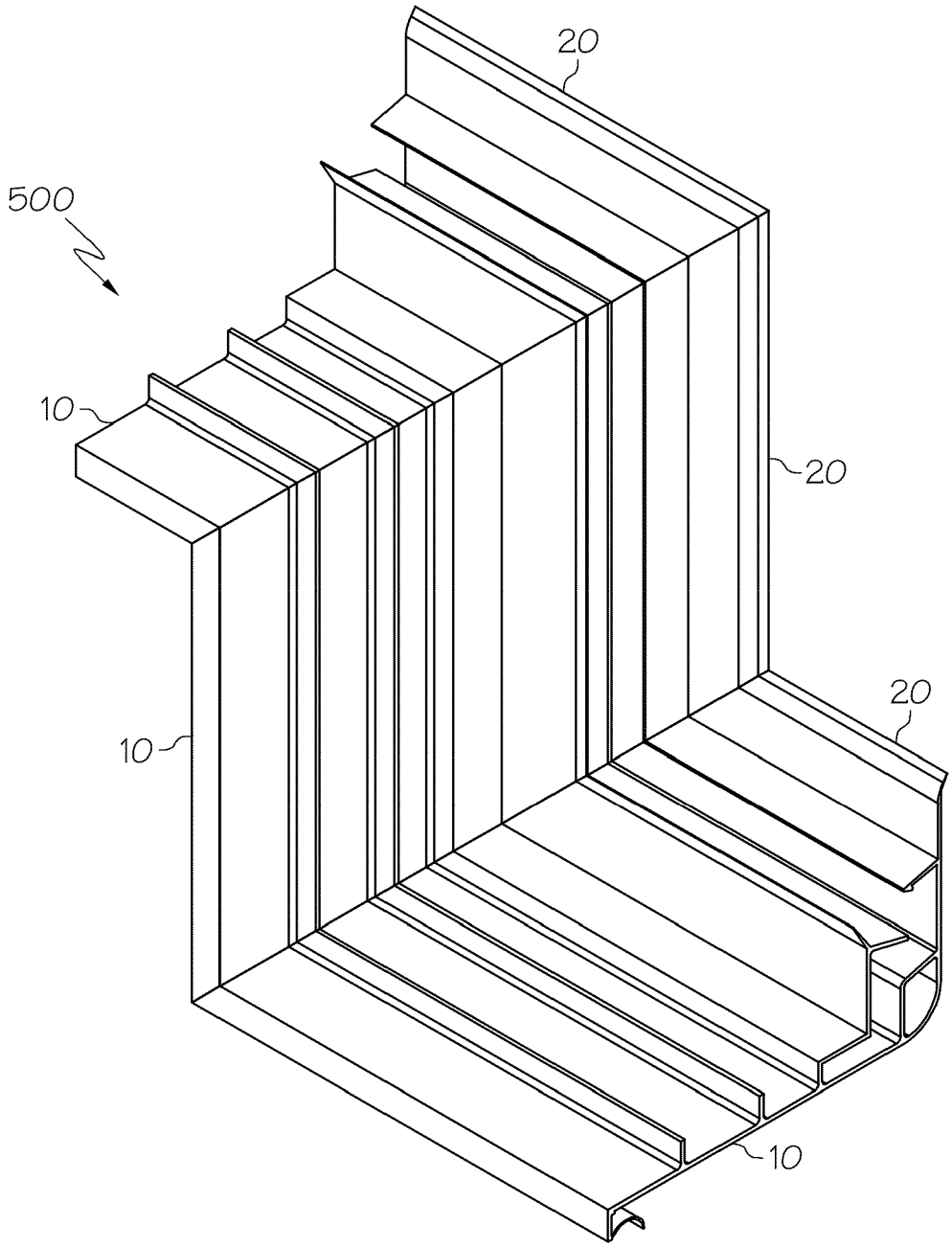
FIG. 7 is a front view of a multilevel water drainage component piece according to one or more embodiments of the present invention.

In yet another embodiment as shown in FIG. 7, the water drainage component 1 defines a multilevel piece 500. The multilevel piece 500 is configured to abut a foundation 110 and structural wall 120 wherein the foundation 110 defines a multilevel step structure. The multilevel piece 500 may be configured to abut a multilevel foundation 110 of variable steps.

Referring to FIGS. 1 and 5, the foundation engaging member 10 comprises a score line 80 extending lengthwise along a portion of the foundation engaging member 10. The score line 80 corresponds to a removable section of the foundation engaging member 10 configured to be removed by severing the removable section from the foundation engaging member 10 along the score line 80. It is further contemplated that multiple score lines 80 may be placed on the foundation engaging member 10, and is further contemplated that score lines 80 may also be placed on the structural wall engaging member 20.

Figure 8:
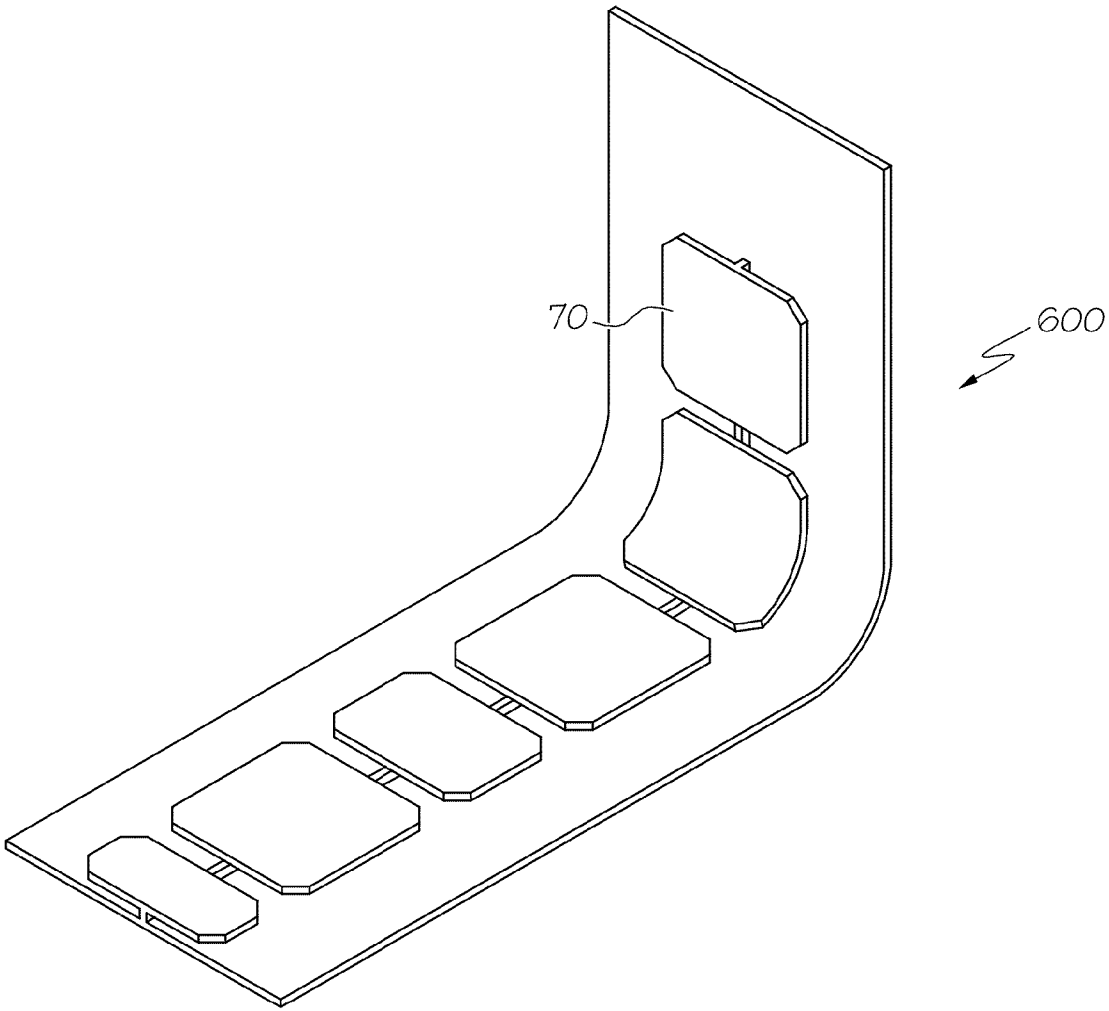
FIG. 8 is a front view of a connector piece according to one or more embodiments of the present invention.

In another embodiment as shown in FIGS. 1, 5, and 8, the water drainage component 1 may further comprise at least one horizontal connector piece 600 configured to couple to at least one water drainage component 1. The water drainage component 1 is coupled to the horizontal connector piece 600 by slidingly inserting at least one track insert 70 extending lengthwise and disposed on the horizontal connector piece 600 into at least one track 12 extending lengthwise along a portion of the foundation engaging member 10 and/or structural wall engaging member 20. As shown in FIGS. 1 and 5, the horizontal connector piece 600 is operable to couple with two water drainage components 1.

In accordance with yet another embodiment as shown in FIG. 3, the water drainage component 1 may further comprise at least one vertical extender piece 50 configured to couple to the structural wall engaging member 20 by any suitable coupling mechanism known to one of ordinary skill in the art. In one embodiment, the coupling between the structural wall engaging member 20 and the vertical extender piece 50 defines a male female-coupling mechanism in which the structural wall engaging member 20 comprises a male component 38 configured to couple with a female component 52 of the vertical extender piece 50. The vertical piece may also comprise another male component, so that another vertical piece could be coupled, thereby achieving variable and unlimited heights. In a further embodiment, the water drainage component may comprise 2 or more staggered vertical extender pieces 50 coupled to one or more water drainage components 1. Furthermore, the vertical extender pieces 50 may comprise a pliable seal 54 configured to contact the structural wall 20. These seals 54 engage the structural wall to ensure that water does not flow behind the water drainage component 1 as additional vertical extender pieces 50 are added, and the height of the water drainage component 1 is increased.

In another embodiment as shown in FIG. 3, the vertical extender piece 50 and the structural wall engaging member 20 comprise nailing plates 90, configured to be aligned when the vertical extender piece 50 and the structural wall engaging member 20 are coupled. The nailing plate 90 comprises material having greater flexibility than the material of the water drainage component 1. The nailing plate 90 produces several benefits for the water drainage component 1. The nailing plates 90 act as a sealing mechanism around a screw head or nail. The nailing plates 90 are configured to seal the gap between the vertical extender piece 50 and the structural wall engaging member 20. Furthermore, the nailing plate 90 is configured to stabilize the vertical piece 50 and prevent cracking of the vertical piece 50.

In another embodiment of the present invention as shown generally in FIGS. 1-9, a system comprising the water drainage component 1 is provided. The system comprises at least one water drainage component 1 comprising a foundation engaging member 10, a structural wall engaging member 20, a gutter 30, and at least one water drainage channel 40. The foundation engaging member 10 is configured to abut a substantially planar portion of a foundation 110 of a building structure 100. The structural wall engaging member 20 is substantially perpendicular to the foundation engaging member 10 and at least a portion of the structural wall engaging member 20 is configured to abut a structural wall 120 of a building structure 100. The gutter 30 defines a water collection area configured to collect water flowing along at least a portion of the structural wall engaging member 20 in the direction of the foundation engaging member 10. The water drainage channel 40 defines a conduit in fluid communication with the water collection area and extending along a portion of the foundation engaging member 10, and the water drainage channel 40 is configured to drain water collected in the gutter 30.

The system further comprises at least one horizontal connector piece 600 configured to couple to at least one water drainage component 1. The water drainage component 1 is coupled to the horizontal connector piece 600 by slidingly inserting at least one track insert 70 extending lengthwise along the horizontal connector piece 600 into at least one track 12 extending lengthwise along a portion of the foundation engaging member 10 and/or the 20 structural wall engaging member. The system also comprises at least one vertical extender piece 50 configured to couple to the structural wall engaging member 20 wherein the coupling between the structural wall engaging member 20 and the vertical extender piece 50 defines a male female-coupling mechanism in which the structural wall engaging member 20 comprises a male component 38 configured to couple with a female component 52 of the vertical extender piece 50.

Referring to FIG. 2, a building structure 100 comprising a water drainage component 1 is provided. The building structure 100 comprises a structural wall 120, an exterior finish 150, and a foundation 110. The water drainage component 1 is positioned between the exterior finish 150 and the structural wall 120 and is configured to abut the foundation 110 and the structural wall 120.

Figure 9:
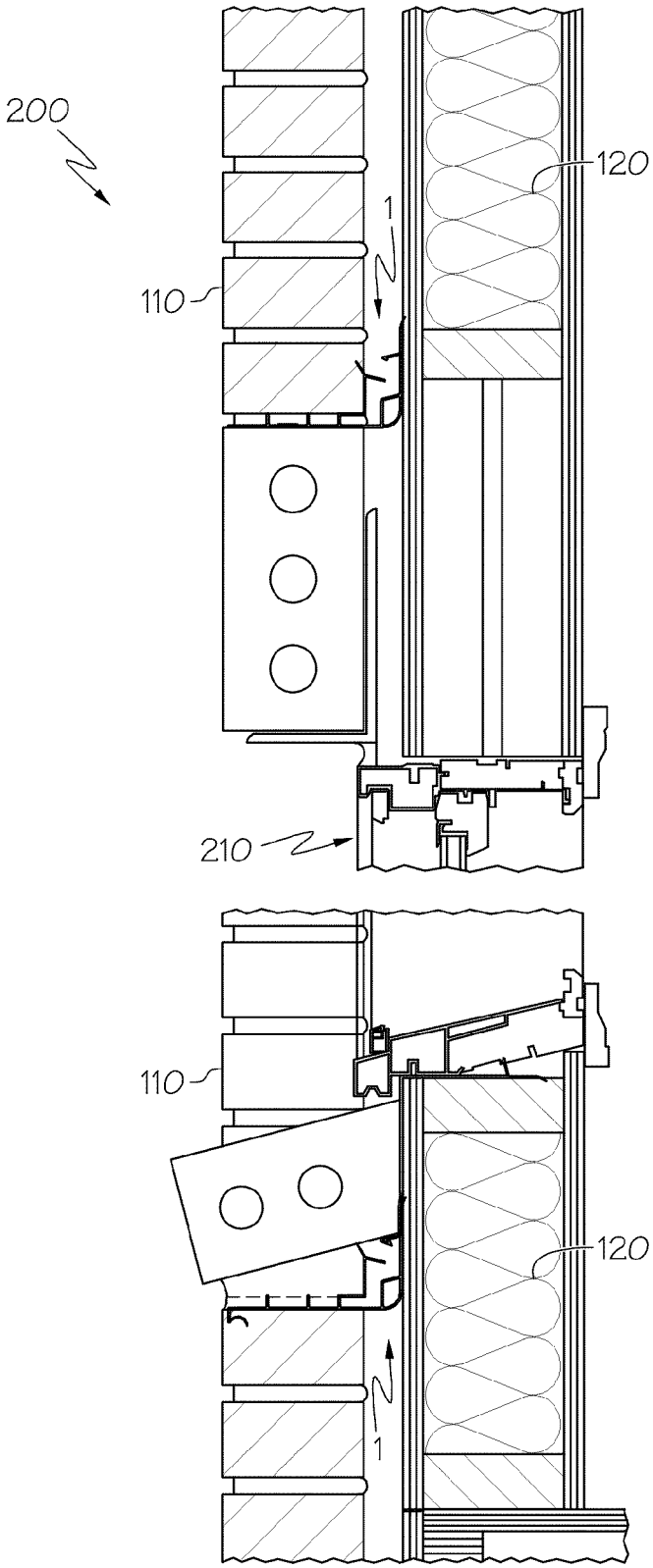
FIG. 9 is a cross sectional view of the water drainage component incorporated into a building structure according to one or more embodiments of the present invention.

Referring to FIG. 9, a window frame 200 comprising a water drainage component 1 is provided. The window frame 200 comprises a structural wall 120, an exterior finish 150, and a window opening 210 disposed in the exterior finish 150. As shown, the water drainage component 1 is positioned between the exterior finish 150 and the structural wall 120 above and/or below the window opening 210 and is configured to abut the structural wall 120.

It is noted that terms like "preferably," "commonly," "generally", "typically" and the like are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A water drainage component comprising a foundation engaging member, a structural wall engaging member, a gutter, and at least one water drainage channel wherein:

the foundation engaging member is configured to abut a substantially planar portion of a foundation of a building structure;

the structural wall engaging member is substantially perpendicular to the foundation engaging member, and at least a portion of the structural wall engaging member is configured to abut a structural wall of a building structure;

the gutter defines a water collection area configured to collect water flowing along at least a portion of the structural wall engaging member in the direction of the foundation engaging member, the water collection area comprising an exterior finish engaging member configured to define a spacing between an exterior finish and a structural wall;

a debris blocking member configured to allow passage of water into the water collection area while preventing passage of mortar into the water collection area, wherein the debris blocking member at least partially covers the water collection area and extends from the exterior finish engaging member or the structural wall engaging member, the debris blocking member comprising a slanted member, a porous straining device, and/or a plurality of opposing staggered projections extending from the exterior finish engaging member and the structural wall engaging member; and the water drainage channel defines a conduit in fluid communication with the water collection area extending along a portion of the foundation engaging member a distance greater than the spacing between the exterior finish engaging member and the structural wall engaging member, and is configured to drain water collected in the water collection area.

2. A water drainage component according to claim 1 wherein the water drainage component defines an extruded cross sectional profile.

3. A water drainage component according to claim 2 wherein the water drainage component comprises a rigid material selected from polyvinyl chloride (PVC), low or high-density polyethylene or polypropylene, acrylics, polycarbonates, thermoplastic elastomers, and combinations thereof.

4. A water drainage component according to claim 1 wherein the water collection area is defined at the junction of the foundation engaging member and the structural wall engaging member.

5. A water drainage component according to claim 1 wherein the exterior finish engaging member, the structural wall engaging member, and the foundation engaging member define the boundaries of the water collection area.

6. A water drainage component according to claim 1 wherein the exterior finish engaging member comprises a pliable seal configured to contact the exterior finish.

7. A water drainage component according to claim 6 wherein the pliable seal comprises material having greater flexibility than the material of the water drainage component.

8. A water drainage component according to claim 1 further comprising a gutter water barrier configured to plug the spacing between the structural wall engaging member and an exterior finish engaging member on at least one end.

9. A water drainage component according to claim 1 wherein the water drainage component comprises a plurality of water drainage channels spaced along the foundation engaging member.

10. A water drainage component according to claim 1 wherein the water drainage channel comprises at least one void formed in the surface of foundation engaging member, and at least one sleeve inserted in the void.

11. A water drainage component according to claim 1 wherein the water drainage component comprises at least one pliable seal oriented at one or more edges of the foundation engaging member and/or the structural wall engaging member.

12. A water drainage component according to claim 11 wherein the at least one pliable seal is configured to contact the foundation and/or the structural wall.

13. A water drainage component according to claim 12 wherein the pliable seal comprises material having greater flexibility than the material of the water drainage component.

14. A water drainage component according to claim 12 wherein the seal located at the edge of the foundation engaging member defines a curved shape configured to engage a foundation edge.

15. A water drainage component according to claim 1 wherein the structural wall engaging member is configured to abut two adjacent structural walls joined at an outer corner.

16. A water drainage component according to claim 1 wherein the structural wall engaging member is configured to abut two adjacent structural walls joined at an inner corner.

17. A water drainage component according to claim 1 wherein the water drainage component is configured to abut a foundation and structural wall wherein the foundation defines a multilevel step structure.

18. A water drainage component according to claim 1 wherein the foundation engaging member comprises a score line extending lengthwise along a portion of the foundation engaging member, wherein the score line corresponds to a removable section of the foundation engaging member configured to be removed by severing the removable section from the foundation engaging member along the score line.

19. A water drainage component according to claim 1 further comprising at least one horizontal connector piece configured to couple to at least one water drainage component.

20. A water drainage component according to claim 19 wherein the water drainage component is coupled to the horizontal connector piece by slidingly inserting at least one track insert extending lengthwise along a portion of the horizontal connector piece into at least one track extending lengthwise along a portion of the foundation engaging member and/or structural wall engaging member.

21. A water drainage component according to claim 19 wherein the horizontal connector piece is operable to couple with two water drainage components.

22. A water drainage component according to claim 1 further comprising at least one vertical extender piece configured to couple to the structural wall engaging member.

23. A water drainage component according to claim 22 wherein the coupling between the structural wall engaging member and the vertical extender piece defines a male female-coupling mechanism in which the structural wall engaging member comprises a male component configured to couple with a female component of the vertical extender piece.

24. A water drainage component according to claim 22 wherein the system comprises two or more staggered vertical extender pieces coupled to one or more water drainage components.

25. A water drainage component according to claim 22 wherein the vertical extender piece comprises a pliable seal configured to contact the structural wall.

26. A water drainage component according to claim 25 wherein the pliable seal comprises material having greater flexibility than the material of the water drainage component.

27. A water drainage component according to claim 22 wherein the vertical extender piece and the structural wall engaging member comprise at least one nailing plate configured to be aligned when the vertical extender piece and the structural wall engaging member are coupled.

28. A water drainage component according to claim 27 wherein the nailing plate comprises material having greater flexibility than the material of the water drainage component.

29. A water drainage component according to claim 27 wherein the nailing plates act as a sealing mechanism around a screw head or nail.

30. A water drainage component according to claim 27 wherein the nailing plates are configured to seal the gap between the vertical extender piece and the structural wall engaging member.

31. A water drainage component according to claim 27 wherein the nailing plate is configured to stabilize the vertical piece and prevent cracking of the vertical piece.

32. A building structure comprising a water drainage component as claimed in claim 1 wherein:

the building structure comprises a structural wall, an exterior finish, and a foundation; and the water drainage component is positioned between the exterior finish and the structural wall and is configured to abut the foundation and the structural wall.

33. A window frame comprising a water drainage component as claimed in claim 1 wherein:

the window frame comprises a structural wall, an exterior finish, and a window opening disposed in the exterior finish; and the water drainage component is positioned between the exterior finish and the structural wall above or below the window opening and is configured to abut the structural wall.

34. A building structure comprising a foundation, a structural wall, an exterior finish, and the water drainage component of claim 1.

35. A system comprising:

at least one water drainage component comprising a foundation engaging member, a structural wall engaging member, a gutter, and at least one water drainage channel wherein:

the foundation engaging member is configured to abut a substantially planar portion of a foundation of a building structure;

the structural wall engaging member is substantially perpendicular to the foundation engaging member and at least a portion of the structural wall engaging member is configured to abut a structural wall of a building structure;

the gutter defines a water collection area configured to collect water flowing along at least a portion of the structural wall engaging member in the direction of the foundation engaging member;

the water drainage channel defines a conduit in fluid communication with the water collection area extending along a portion of the foundation engaging member, and is configured to drain water collected in the gutter, at least one horizontal connector piece configured to couple to at least one water drainage component, wherein:

the water drainage component is coupled to the horizontal connector piece by slidingly inserting at least one track insert extending lengthwise along the horizontal connector piece into at least one track extending lengthwise along a portion of the foundation engaging member and/or structural wall engaging member; and at least one vertical extender piece configured to couple to the structural wall engaging member wherein:

the coupling between the structural wall engaging member and the vertical extender piece defines a male female-coupling mechanism in which the structural wall engaging member comprises a male component configured to couple with a female component of the vertical extender piece.

36. A water drainage component comprising a foundation engaging member, a structural wall engaging member, a gutter, and at least one water drainage channel wherein:

the foundation engaging member is configured to abut a substantially planar portion of a foundation of a building structure;

the structural wall engaging member is substantially perpendicular to the foundation engaging member, and at least a portion of the structural wall engaging member is configured to abut a structural wall of a building structure;

the gutter defines a water collection area configured to collect water flowing along at least a portion of the structural wall engaging member in the direction of the foundation engaging member, wherein the water collection area comprises an exterior finish engaging member configured to define a spacing between an exterior finish and a structural wall, the exterior finish engaging member comprises a pliable seal configured to contact the exterior finish; and the water drainage channel defines a conduit in fluid communication with the water collection area extending along a portion of the foundation engaging member, and is configured to drain water collected in the water collection area.

37. A building structure comprising a foundation, a structural wall, an exterior finish, and the water drainage component of claim 36.

* * * * *

UNITED STATES PATENT AND TRADEMARK OFFICE

CERTIFICATE OF CORRECTION

PATENT NO. : 7,621,079 B2
APPLICATION NO. : 11/267412
DATED : November 24, 2009
INVENTOR(S) : Takagi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1052 days.

Signed and Sealed this

Twenty-sixth Day of October, 2010

David J. Kappos

David J. Kappos
*Director of the United States Patent and Trademark Office*